US005702326A

United States Patent [19]

Renteria

[11] Patent Number: 5,702,326

[45] Date of Patent: Dec. 30, 1997

[54] WALKING ASSISTANCE DEVICE

[75] Inventor: William Renteria, Lakewood, Colo.

[73] Assignee: Versatex Inc., Lakewood, Colo.

[21] Appl. No.: 651,872

[22] Filed: May 21, 1996

[51] Int. Cl.[6] ..... A63B 22/20

[52] U.S. Cl. ..... 482/68; 135/67

[58] Field of Search ..... 482/68; 280/87.021, 280/87.041; 135/67, 68

[56] References Cited

U.S. PATENT DOCUMENTS

| | | | |
|---|---|---|---|
| 3,580,569 | 5/1971 | Wilson | 482/68 X |
| 3,828,392 | 8/1974 | Bolger | 16/35 R |
| 3,924,292 | 12/1975 | Christensen | 16/35 D |
| 4,035,864 | 7/1977 | Schroder | 16/35 R |
| 4,184,618 | 1/1980 | Jones | 135/67 X |
| 4,205,413 | 6/1980 | Collignon et al. | 16/35 D |
| 4,239,248 | 12/1980 | Ewers | 482/68 X |
| 4,248,445 | 2/1981 | Vassar | 280/79.1 R |
| 4,461,471 | 7/1984 | Brastow | 482/68 |
| 5,380,262 | 1/1995 | Austin | 482/68 |
| 5,451,193 | 9/1995 | Pickard | 482/68 |
| 5,502,851 | 4/1996 | Costello | 5/86.1 |
| 5,517,718 | 5/1996 | Eichhorn | 16/35 R |
| 5,538,268 | 7/1996 | Miller | 482/68 X |

FOREIGN PATENT DOCUMENTS

| | | | |
|---|---|---|---|
| 2127705 | 5/1984 | United Kingdom | 482/68 |

*Primary Examiner*—Richard J. Apley
*Assistant Examiner*—William LaMarca
*Attorney, Agent, or Firm*—Ramon L. Pizarro; Edwin H. Crabtree

[57] ABSTRACT

A walking assistance device for use in indoor areas as well as in outdoor areas includes a frame with a pair of spaced apart sides and a pair of front wheels mounted to the frame in a manner that allows each of the front wheels to rotate about a vertical axis. A seat support is mounted between the spaced apart sides and at least one rear wheel attached to the frame in a manner that allows the rotation of the rear wheel or wheels about a vertical axis. A straddleable seat is mounted on the seat support on the frame. A slideable collar is attached to the frame in a manner that allows the user to selectively prevent the rotation of the rear wheel about a vertical axis, so that a person's body weight may be at least partially supported by the straddleable seat and the rear wheel allowed to rotate about a vertical axis as a person walks in an indoor area, and so that a person's body weight may be at least partially supported by the straddleable seat and the rear wheel prevented from rotating about a vertical axis as a person walks in an outdoor area.

14 Claims, 9 Drawing Sheets

WALKING ASSISTANCE DEVICE

BACKGROUND OF THE INVENTION (a) Field of the Invention

This invention generally relates to the field of devices for assisting people with temporary, chronic, or degenerative impairment to their walking abilities, and more particularly, but not by way of limitation, to a walking assistance device which can be used indoors or outdoors and that aids the user by supporting some or all of the user's weight depending on the user's needs.

(b) Discussion of Prior Art

Our society places a great deal of value on independence and self-reliance. Accordingly, many devices have been introduced to help an individual who begins to lose his independence due to congenital, degenerative or accidental damage to the body's systems which allow the person to walk. Well known devices such as wheel chairs have been widely used. Wheel chairs, however, which obviate the individual's need for legs are too drastic of an approach, especially for individuals who merely have reduced ability to use their legs. Moreover, the lowering of a persons head to a position where he may no longer talk to others at eye level can be demoralizing and adverse to the person's overall well-being. Still further, the wheel chair's total obviation of the need to use one's legs prevents the injured person from gaining valuable exercise. Thus the use of the wheel chair can lead to further deterioration of the injured person's limbs.

Other devices have been introduced to help individuals who have some use of their legs, but need some assistance from time to time. A well known example of this kind of device is the walker, which typically includes a light, generally U-shaped frame which fits around the user, below the user's waist. To use these devices requires the user must lift and move the walker forward in order to provide a moving support while walking. To alleviate this cumbersome requirement inventions such as disclosed in U.S. Pat. No. 5,020,560 to Turbeville and U.S. Pat. No. 4,159,110 to Dodenhoff have incorporated the use of wheels and the Turbeville device even included a braking mechanism which improved the device's portability and safety. These devices, however, typically require a great deal of user interaction by requiring that the user grab the walker, move the walker forward, and then hold on to the walker while moving the legs forward. This interaction generally allows the user to concentrate only on moving the walker and moving forward, and does not allow the user to move around while performing chores around the house, for example.

Another approach has been to provide a relatively high seat supported by a frame that requires that the user straddle the frame while propelling himself with the use of his legs. This approach has been used in the devices taught by U.S. Pat. Nos. 5,167,597 to David, 5,158,313 to Becker, 4,861,051 to Napper, 4,187,869 to Marchetti, 4,065,145 to Chambers, and 3,180,678 to McCabe. By requiring that the user straddle part of the frame of the device one imposes the burden of having to raise a leg over the straddled member when trying to mount the device, an action which can be very difficult and dangerous for people with weakened legs. Moreover, in most of these devices the straddled member can bump up against the user's ankles, causing discomfort and difficulty in using the device. Even more hazardous, the straddled member or its structure can cause the user to trip over the member, placing the weakened person at risk of falling.

While the known devices recognize the need to provide a safe device that assists individuals who have reduced use of their legs in moving around indoors or outdoors. The unevenness of paths and streets can make it very difficult for individuals to maneuver or propel devices such as the Marchetti device disclosed in U.S. Pat. No. 4,187,869, which places a pair of front wheels at a distance which is close to being almost immediately below the user's center of gravity. Similarly, devices such as the Napper device, disclosed in U.S. Pat. No. 4,861,051, are designed to support a majority of a person's weight while the person is in a seated position with a part of the seat impairing motion of the user's femur, so that the user's natural leg motion is impaired by the seat of the device. This type of support can reduce the effectiveness of the user already weak legs to the point to where outdoor use of the device becomes impossible.

Still another problem left unattended by the known prior art is that these devices have had to compromise steerabilty in order to allow indoor and outdoor use. This limitation is typically a result of the fact that one cannot incorporate wheels that can turn about a vertical axis because these wheels will allow the device to move sideways when the user is trying to move along a constant level on a path with a gradient normal to the direction of desired motion. This situation can present itself when trying to walk across a driveway, for example. In order to overcome this problem many devices include an axle with a fixed orientation and another axle with a wheel or wheels that can turn about a vertical axis. This arrangement, however, compromises or reduces the maneuverability of the device. The reduced maneuverability is especially detrimental when needing to move around indoors, where a person may need to face in one direction while using a kitchen sink and an opposite direction when taking things out of a refrigerator located opposite to the sink.

Thus, there remains a need for a simple, safe device for assisting individuals in walking with the use of their legs and weight for providing forward motion.

Moreover, there remains a need for a walking assistance device that can be used indoors or outdoors while providing a high degree of maneuverability.

There remains a need for a versatile walking assistance device that does not have to be straddled, and that allows the user to perform household tasks. There remains a need for walking assistance device that allows the user to perform tasks and provide secure support over several parts of the user's body.

SUMMARY

It has been discovered that the problems left unanswered by the known prior art can be solved by providing a walking assistance device that can be used for indoor areas as well as in outdoor areas, by including the following elements in a walking assistance device:

a) a frame with a pair of spaced apart sides and with a pair of front wheels which are rotatable about a vertical axis;

b) a seat support which can support a straddleable seat which allows forward and aft motion of a user's legs is mounted between the spaced apart sides of the frame;

c) at least one rear wheel attached to the frame on a support that allows rotation of the rear wheel or wheels about a vertical axis; and b) a slideable collar which can prevent the rotation of the rear wheel or wheels about the vertical axis, so that a person's body weight may be at least partially supported by the straddleable seat and the rear wheel is allowed to rotate about a vertical axis as a person walks in an indoor area, and so that a person's body weight may be at least partially supported by said straddleable seat and the rear wheel prevented from rotating about a vertical axis as a person walks in an outdoor area so that the person may gain additional control of the device when using the device in outdoor areas.

Thus it can be appreciated that an important aspect of the invention is that the spaced apart sides of the frame allow unimpeded access to the seat. Also, the seat is a straddleable seat which supports the person's body primarily through the person's crotch area, much like a bicycle seat. Still further, the device incorporates a slideable collar which mounts on the rear wheel support structure and can be moved to different positions on the wheel support structure in order to selectively prevent rotation of the rear wheel or wheels about a vertical axis. The ability to selectively engage the rotation of the rear wheels about a vertical axis results in increased versatility of the device. It is essential that a walking assistance device that is to be used indoors be highly maneuverable, so that person may maneuver around the many obstacles typically found inside a home or other indoor areas. This maneuverability is achieved in the instant invention by incorporating wheels mounted on wheel support structure that allows the wheels to rotate about a vertical axis. It is also beneficial to incorporate a caster type angle to the support structure so that the wheels will be self-righting. This structure will allow the invention to be rotateable over a single point which lies immediately below the user's body.

However, the maneuverability imparted by the structure which allows all wheels to turn about a vertical axis can be hazardous when using the device in outdoor areas. This is because of the irregularities of outdoor surfaces. A user will frequently find himself having to walk in a direction that is perpendicular to the direction of a gradient. Consequently if the wheels are self-righting and capable of turning about a vertical axis the user will find himself rolling away out of control. Therefore, a very important feature of the instant invention is the inclusion of a means for .selectively preventing the rotation of the rear wheel or wheels about a vertical axis. By preventing the rotation of the rear wheel or wheels about a vertical axis one can produce a more stable, more controllable device which can be safely used outdoors.

Another important feature of the means for selectively preventing rotation of the rear wheel or wheels about a vertical axis is the inclusion of a tab that can moved to a first position where the rotation of the rear wheel or wheels about a vertical axis is unimpeded, then to a second position where the rotation of the rear wheel or wheels about a vertical axis is impeded, and then to a third position where the tab makes contact with the wheel, thereby preventing rotation as well as allowing the braking of the rear wheel or wheels.

Yet another important aspect of the instant invention is the inclusion of a pair of swing away arm supports which can be telescopically mounted to the spaced apart members of the frame. These arm supports can be used to help the user to evenly distribute his body weight on the device, as well as provide a point which can be used to push the device by the user.

Thus an important feature of the invention is that it can be used to support some or all of the user's weight, depending on whether the user wants to walk or just rest on the device. Partial support of the user's weight while walking allows the user to use his weight to help move the device forward. Also, the partial support of the user's weight with a straddleable seat allows the user to move his legs in a natural, upright fashion without bumping into a frame member while walking.

It has been found that while walking, a person's stride combines a forward lean with a rolling, or pivoting, motion about the person's hips. Thus, to allow natural mobility one must allow the user's legs to push the body forward as well as rotate, or pivot, about the hip in order to enhance a natural forward lean. The pivoting of the leg about the hip as the body moves forward results in the pivoting of the leg about the ankle area and about the hip area. This pivoting about the ankle as the body moves forward creates an arch motion with the high point of the hip at the point where the leg is in a vertical position relative to the ground. Thus, when moving forward a person uses the lean, or drop, caused by the leg's passing over the high point of the arch created by the leg's motion about the ankle, to propel the body forward.

Accordingly, devices that prevent the user from using this slight forward lean, or drop, make it very difficult for the user to move forward because the user must rely entirely on his muscles for a forward push. This is a serious limitation for individuals who use these devices, since their legs have already been weakened.

Therefore, the disclosed invention allows mobility while not requiring the support the user's entire weight while walking. The disclosed invention allows the user to engage in natural walking motion by supporting a portion of the user's weight on a straddleable seat. The natural motion accomplished by allowing the user's legs to exert a forward push as well as to allow the user to use his weight in a forward lean that he can use to move forward.

By mounting the straddleable seat on a frame structure that provides clearance below the seat one can create a device that allows natural, unobstructed walking stride. The spaced apart members of the frame structure of the instant invention allow the mounting of a seat support at a position where interference of the frame structure with the user's legs is highly unlikely.

According to yet another aspect of the invention, it has been discovered that by incorporating means for attaching a body support to the arm supports of the device, as well as means for attaching tools such as a tray to the arm supports, one can allow a person to gain mobility and the independence of allowing the person to carry out tasks.

Thus it will be understood by scientists, engineers, and those skilled in the art that the disclosed invention provides a walking assistance device that allows the user to walk in a natural manner.

Importantly, the invention also solves problems associated with devices that can only be used safely indoors or outdoors. The invention incorporates means for selectively allowing the free rotation of the rear wheel or wheels of the device, and thus allowing a high degree of maneuverability when using the device indoors, and allowing the control required for using the device outdoors.

Also, it will be readily understood that the disclosed invention can be easily collapsed, and thus allowing ease of storage and transportation.

Moreover, now with this summary it will become apparent that the improved mobility and versatility achieved with the invention are highly desirable and useful results that were not equally achievable with technology in the known prior art.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it is understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
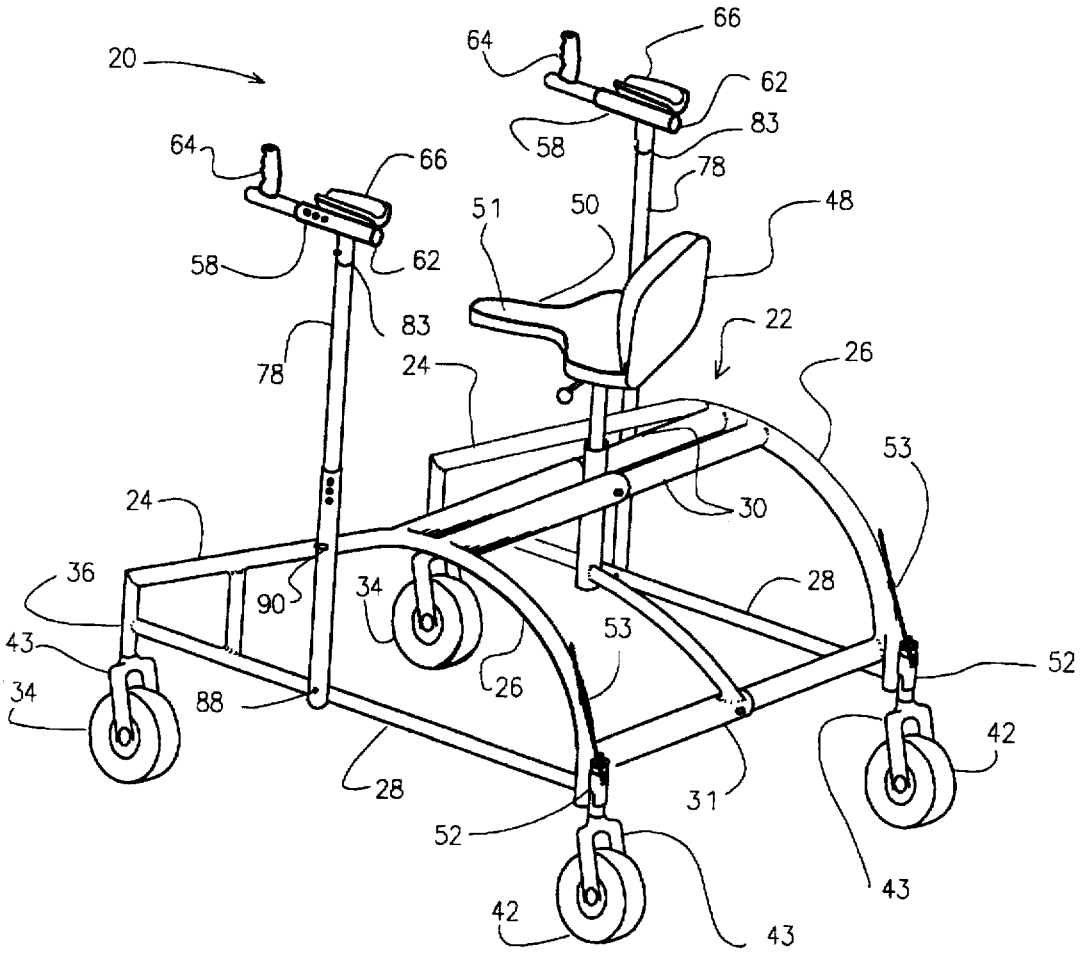
FIG. 1 is a perspective view of the invention.

Turning now to FIG. 1, where a walking assistance device 20 for use in indoor areas as well as in outdoor areas has been illustrated. The walking assistance device 20 has been shown having a frame means 22 which generally includes a pair of spaced apart sides 24. The spaced apart sides 24 have been constructed by joining a generally arched member 26 with a straight member 28 within the concave region of the arched member 26. This construction of the sides 24 of the frame means 22 provides an efficient and versatile structure that can be joined by means of a pair of telescoping cross members 30 and a rear support member 31, while providing ample clearance for allowing a natural stride by the user.

It is advantageous to incorporate a telescoping means to telescoping cross members 30 in order to allow the sides 24 to collapse towards one another to facilitate the portability and stowage characteristics of the invention. However, it is contemplated that scissoring elements or cross-supports may be used to provide collapsibility and to connect the two sides 24.

It is also important to note that the preferred embodiment includes the telescoping cross members 30 at a point on the sides 24 which allows a great deal of clearance below the cross members 30. This clearance is very important in allowing room for the user's legs in order to produce a device that allows the user to walk in a natural manner. Thus, by connecting the two sides 24 with telescoping cross members 30 one produces a simple, but highly functional connection.

Also shown on FIG. 1 is that the walking assistance device 20 includes a pair of front wheels 34 mounted to the frame means 22 by means of a wheel support structure 43. The front wheels 34 are preferably connected to a forward end 36 of the sides 24 in a manner that allows rotation of each of the front wheels 34 about a vertical axis 38. The rotation of the front wheels 34 about the vertical axis 38 can be accomplished by incorporating means for allowing rotation of the wheels, these means may include bushings or bearings supporting the wheel support structure 32, or other attachment means incorporated into the forward end 36 of the sides 24.

Figure 2:
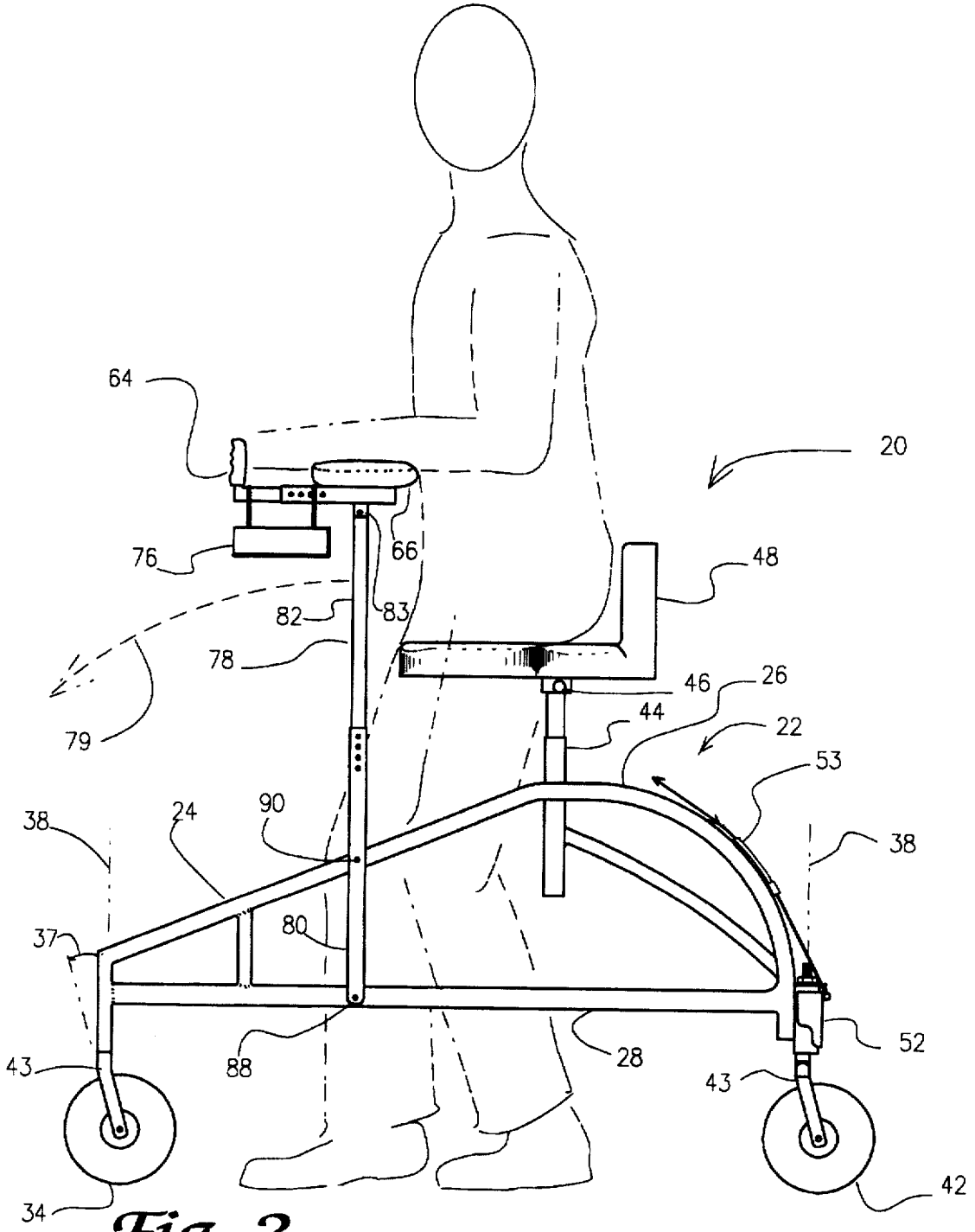
FIG. 2 is a side view of the invention including the outline of an individual using the invention.
Figure 3:
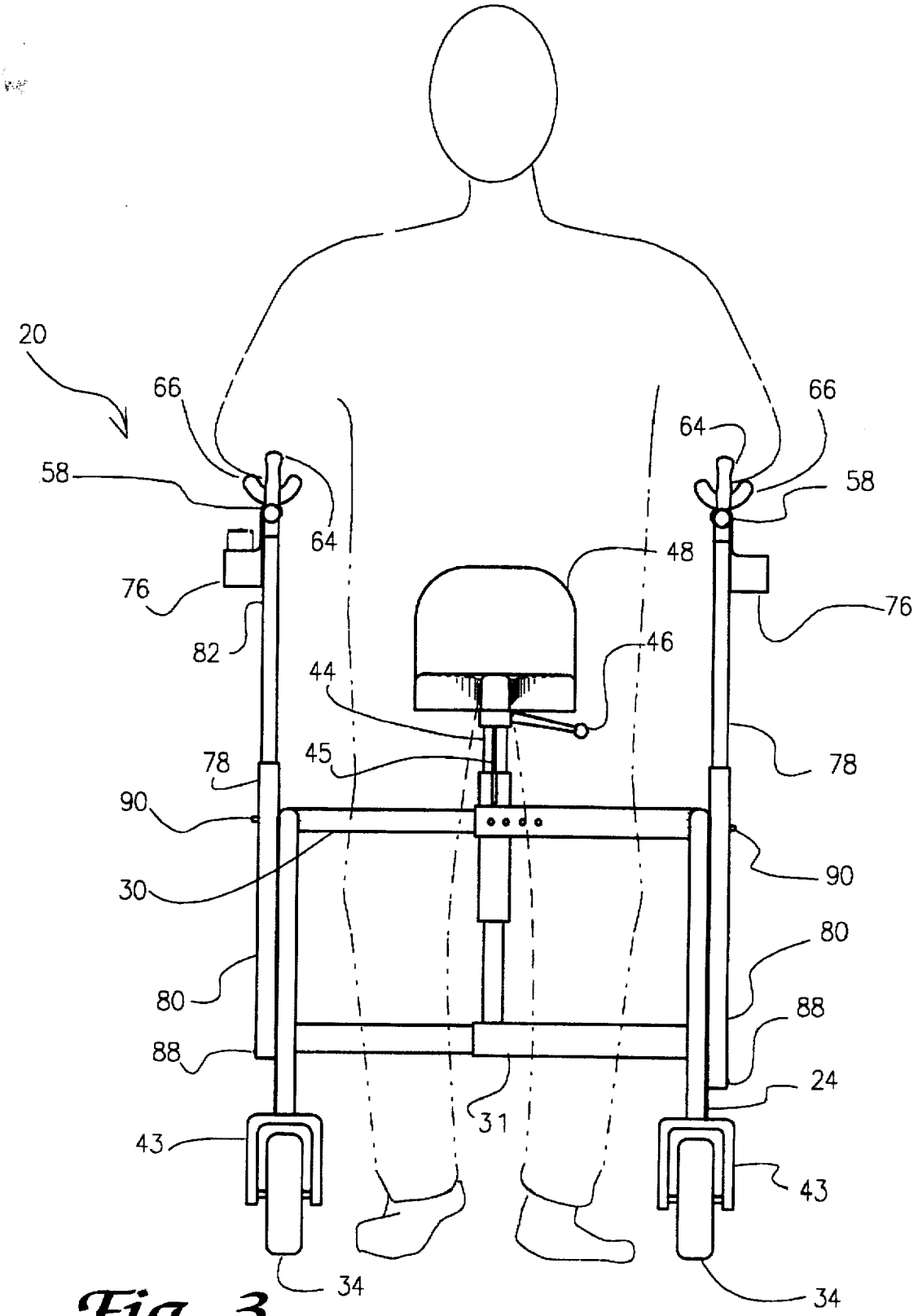
FIG. 3 is front view of the device, the view also including the outline of an individual using the device.
Figure 4:
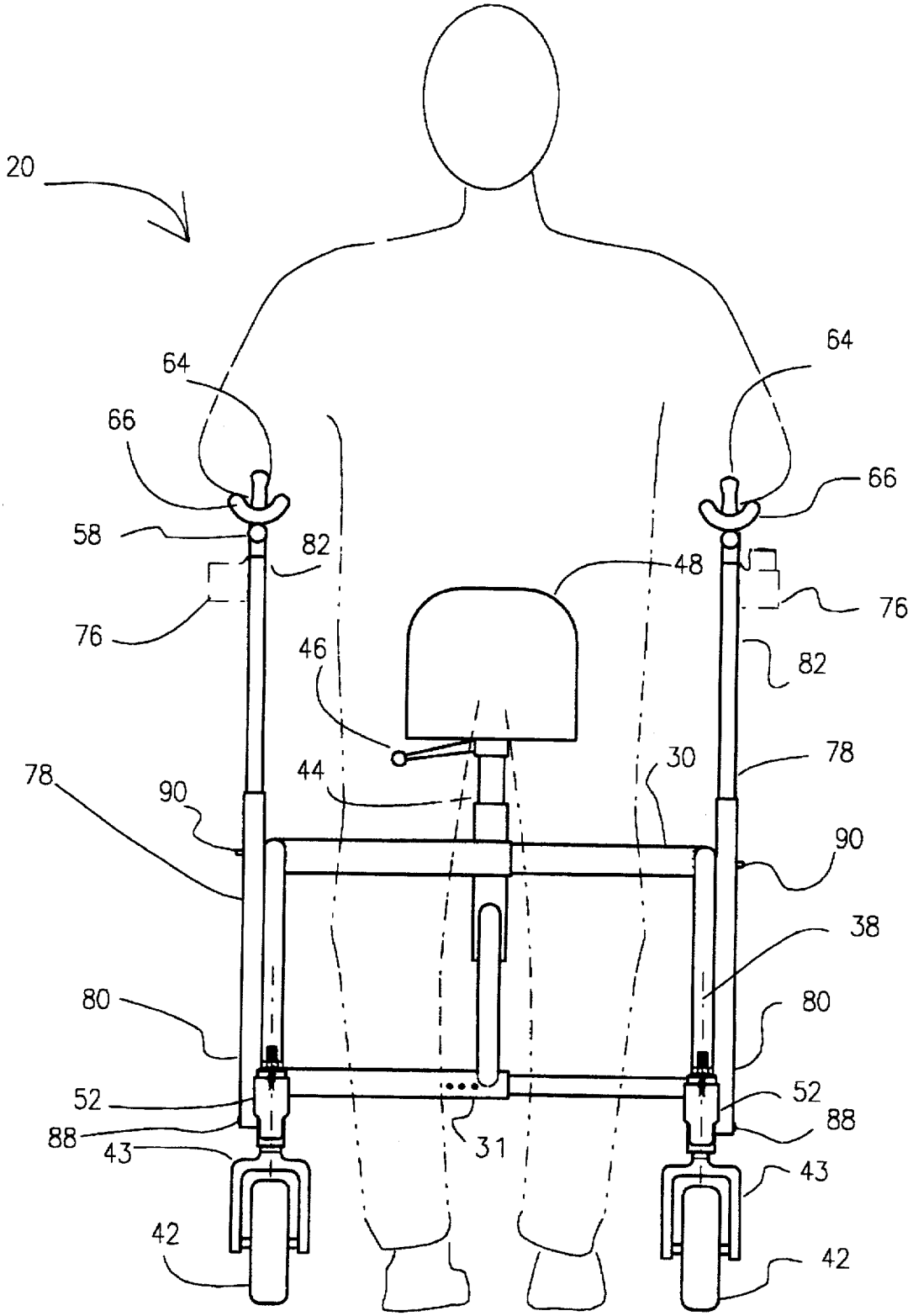
FIG. 4 is a rear view of the device, the view also including the outline of an individual using the device.
Figure 5:
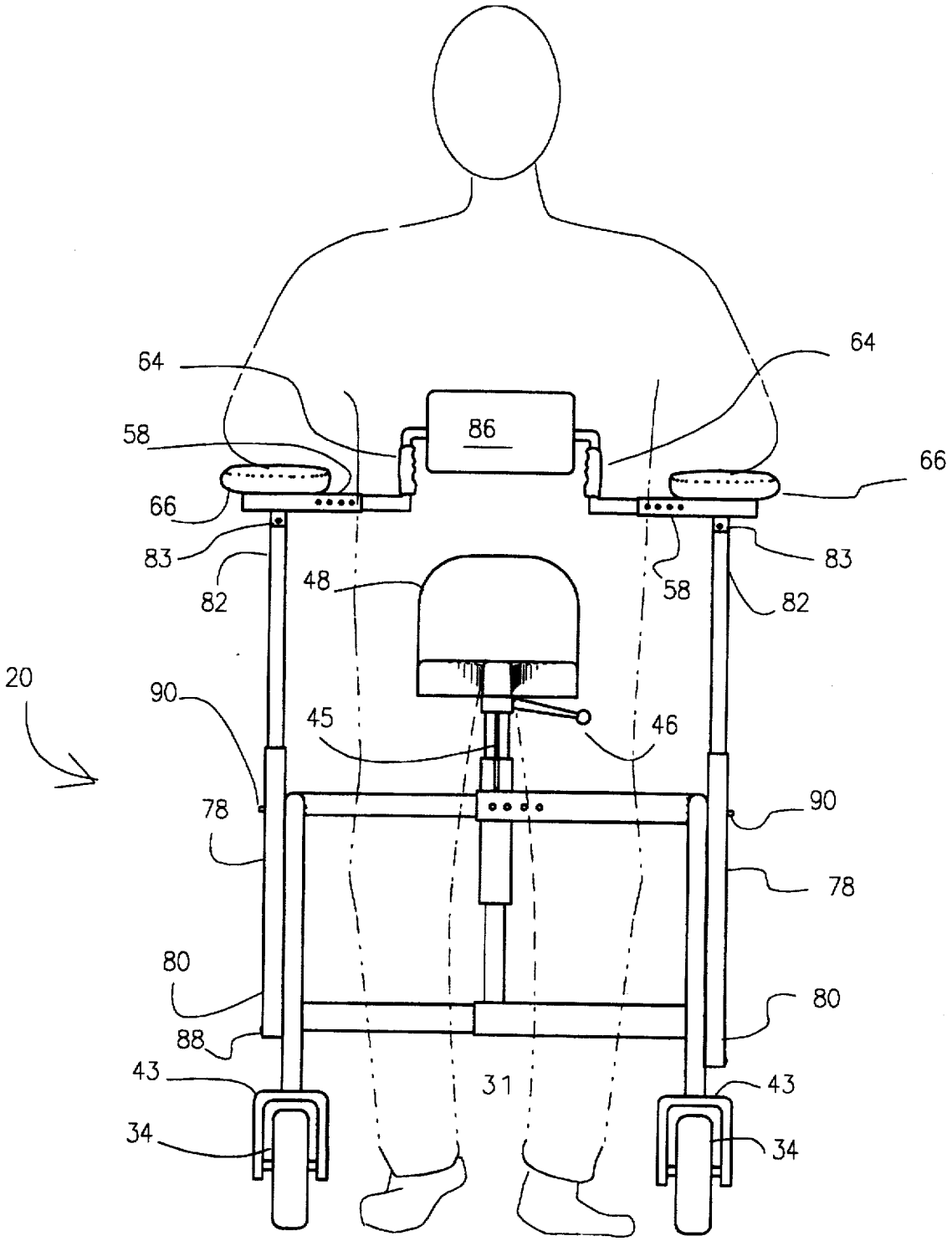
FIG. 5 is a front view of the invention being used with an abdominal support attached between the arm supports.
Figure 6:
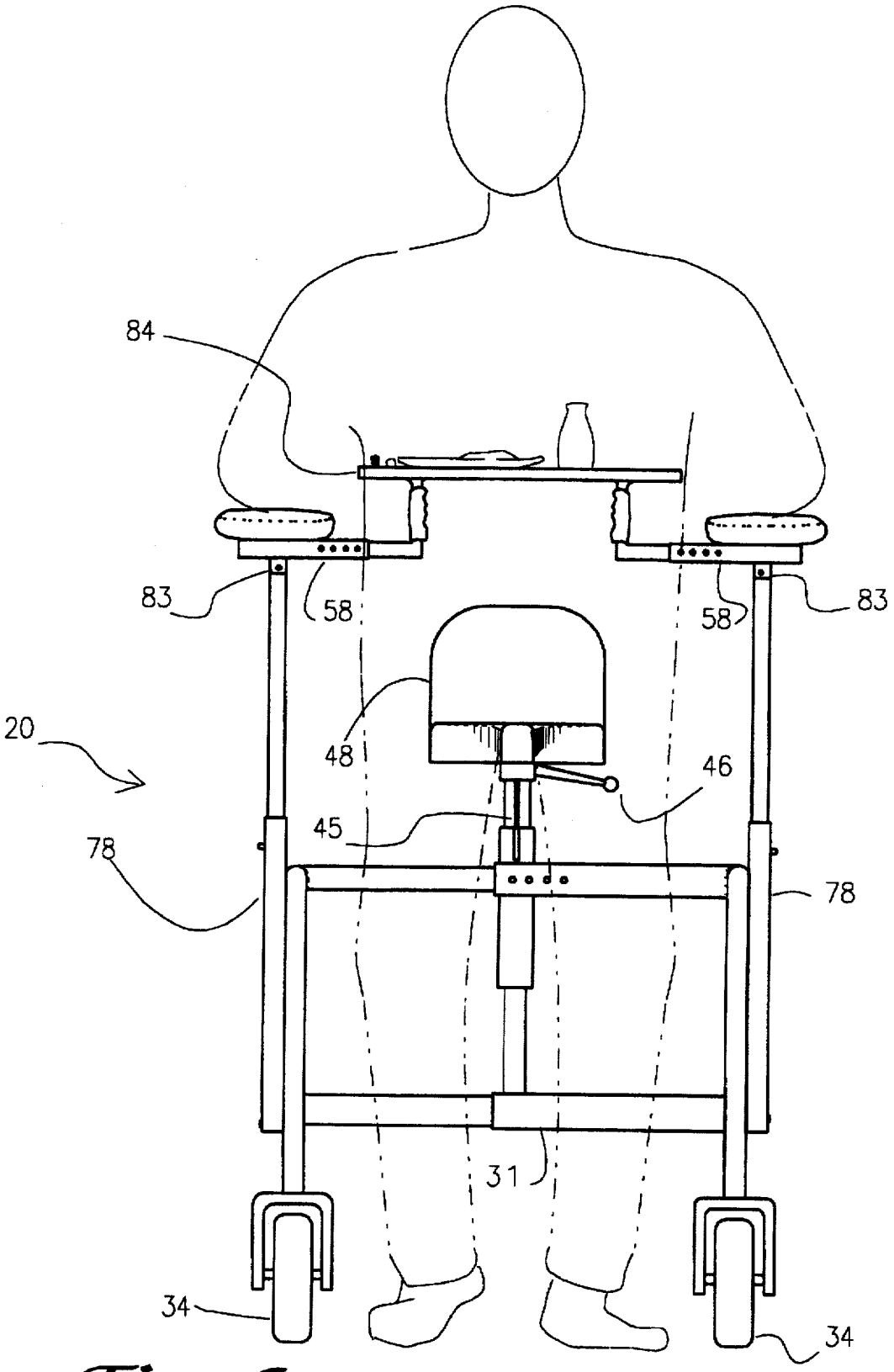
FIG. 6 is a front view of the invention being used with a tool, a tray, being used to carry a meal with the device.
Figure 7:
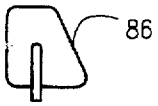
FIG. 7 is a side view of the body support illustrated in use in FIG. 5.
Figure 8:
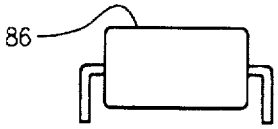
FIG. 8 is a front view of the body support illustrated in use in FIG. 5.
Figure 9:
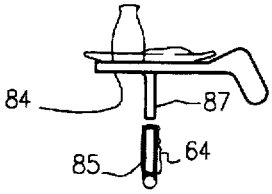
FIG. 9 is a side view of the tray illustrated in use in FIG. 6.
Figure 10:
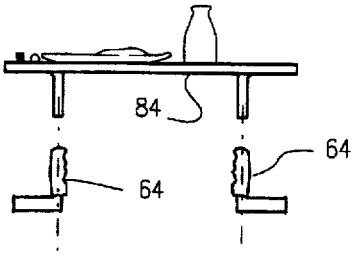
FIG. 10 is a front view of the tray illustrated in use in FIG. 6, the view showing a manner of attachment of the tray to the hand grips on the arm supports.
Figure 11:
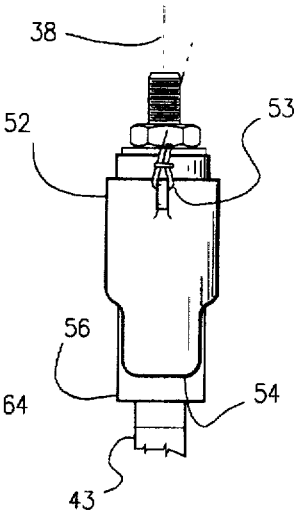
FIG. 11 is a view looking forward on to a preferred embodiment of a sliding collar used to prevent rotation of the rear wheel or wheels about a vertical axis.

Referring now to FIG. 2 it can be seen that the wheel support structure 43 includes a caster angle 37. The caster angle 37 allows self alignment or straightening of the front wheels in a direction of motion in a well known manner.

As has been illustrated on FIGS. 1 and 2, attached to an aft end 40 of the sides 24 is at least one wheel 42 mounted on wheel support structure 43 which allows rotation of each of the rear wheels 42 to rotate about a vertical axis 38. In a highly preferred embodiment an aft wheel 42 is incorporated into each aft end 40 of the sides 24. Each of the aft wheels 42 is attached to the aft end 40 of the sides 24 by the rear wheel support structure 43, which allows rotation of the rear wheels 42 about the vertical axis 38. With this highly preferred embodiment, the rear wheels 42 as well as the front wheels 34 include a caster angle 37 which allows self righting, or following, operation achieved with a caster arrangement. Thus, with this arrangement the frame 22 together with the wheel arrangement provide a highly maneuverable platform for the walking assistance device 20. The high maneuverability of this arrangement being attributable in large part to the fact that the wheels are free to rotate about a vertical axis 38.

Attached to the telescoping cross members 30, and mounted between the spaced apart sides 24, is a seat support means which in a preferred embodiment is a spring loaded, adjustable pneumatic cylinder 44. The adjustable pneumatic cylinder 44 is adjusted by means of the handle 46, which controls the entry or exit of air from the pneumatic cylinder 44. While it is contemplated that other mechanisms may be used for providing a seat support means, for example screw mechanisms or adjustable clamping devices, the pneumatic cylinder 46 is highly preferred due its ability to absorb shock while providing the adjustability function.

Mounted on the pneumatic cylinder 44 is a straddleable seat means, which in a preferred embodiment is a seat 48 with a long narrow portion 50 that allows the user's weight to be supported by a crotch support area 51 much like the support provided by a bicycle seat. By mounting the seat 48 on the pneumatic cylinder 44, and supporting the pneumatic cylinder 44 on the telescoping cross members 30 one provides a structure with ample clearance While walking and that can be mounted without having to lift a leg over any frame component. Mounted on the cylinder 44 is a guide 45 which ensures that the cylinder 44 and seat 48 assembly remain in a fixed orientation, so that the seat will not pivot about the cylinder.

To mount the invention 20, the user simply walks between the spaced apart sides 24 and backs up over the crotch support area 51 of the seat 48. Once standing over the crotch support area 51 of the seat 48, the user may simply pull the handle 46 and cause the spring in the pneumatic cylinder 44 to raise the seat 48 to the desired height to achieve the desired support of the user's weight.

Turning now to FIGS. 2,4, and 11 through 14, where it has been illustrated that at the aft end 40 of the sides 24, and between the sides 24 and the aft wheels 42 a means for selectively preventing the rotation of the rear wheels 42, meaning turning of the wheel support structure 43 about the vertical axis 38 has been incorporated to the invention. The means for selectively preventing the rotation of the rear wheels 42, is preferably a slideable collar 52 having means for engaging the wheel support structure 43 in order to prevent the wheel support structure 43 from rotating about the vertical axis 38. In a preferred embodiment detailed in FIGS. 11 through 14, the means for engaging the wheel support structure 43 includes a tab 54 which protrudes from the slideable collar 52.

The slideable collar 52 may preferably slide over a section of tubing 56 which is attached to the aft end 40 of the frame 22. In an embodiment of the invention the slideable collar 52 fits over tubing 56, but does not extend completely around the tubing 56. This installation prevents rotation of the collar 52 about the tubing 56, but allows the collar 52 to slide along the tubing 56.

The slideable collar 52 may also be conveniently attached to aft end 40 of the sides 24. One of the key factors being providing an attachment that allows the user to vary the position of the means for selectively preventing the rotation of the rear wheels 42 about the vertical axis 38.

Figure 15:
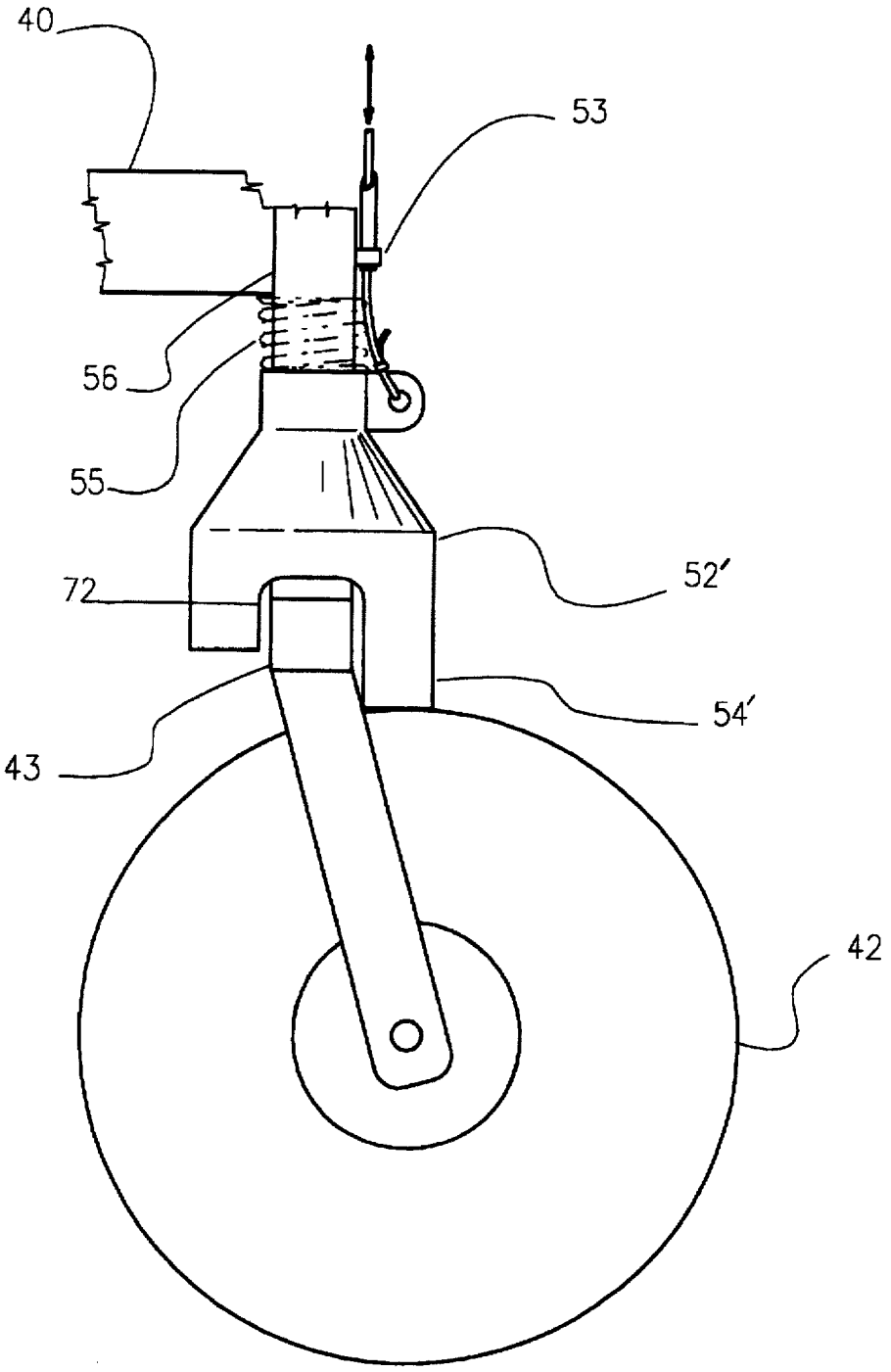
FIG. 15 is a side view of another embodiment of the sliding collar.

Moreover, the shape of the means for selectively preventing the rotation of the rear wheels may be varied as has been illustrated in FIG. 15. FIG. 15 shows a contemplated alternative embodiment for the means for selectively preventing the rotation of the rear wheel, or wheels, includes the collar 52' with the tab 54' and a notch 72 which straddles the wheel support structure 43. The collar 52' is shown mounted on the tubing 56, and is shown including a spring 55 which can be used to bias the collar 54' towards the wheel 42. With this contemplated arrangement, the means for controlling the position of the collar 52' would have to be connected to a mechanism which locks the collar 54' in the desired location with respect to the wheel 42.

While the collar 52' has been shown with the spring 55, it is also contemplated that a spring may be used with the collar arrangement shown on FIGS. 11 through 14. This system would also require an adjustment mechanism that would allow locking the collar 52 in different positions relative to the wheel 42. It is contemplated that a mechanism similar to the cable actuators used with the shift mechanisms used on bicycles could be used for this purpose.

Figure 12:
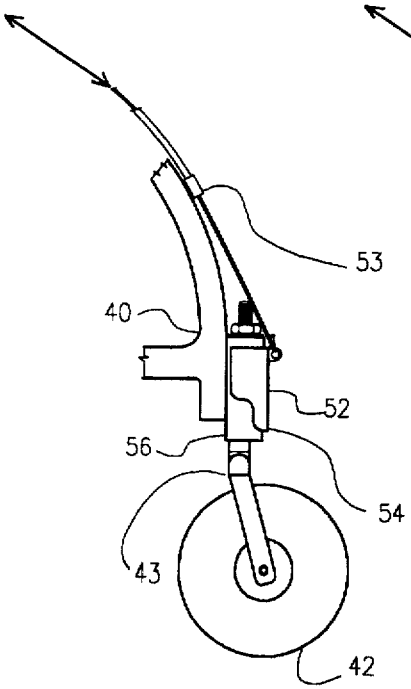
FIG. 12 is a side view of a preferred embodiment of a sliding collar used to prevent rotation of the rear wheel or wheels about a vertical axis, the view shows the collar in a position that allows unimpeded rotation of the rear wheel about a vertical axis.
Figure 13:
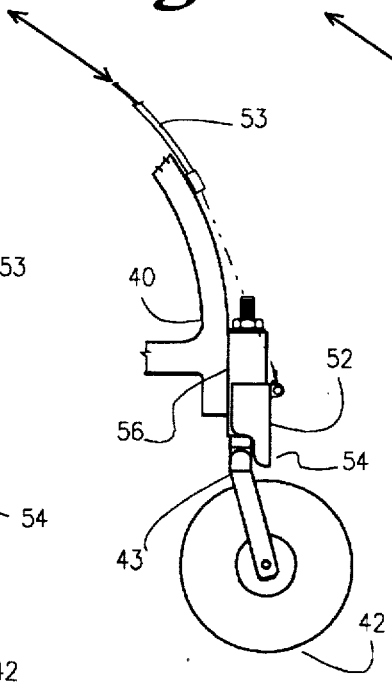
FIG. 13 is a side view of a preferred embodiment of a sliding collar used to prevent rotation of the rear wheel or wheels about a vertical axis, the view shows the collar in a position that impedes rotation of the rear wheel about a vertical axis.
Figure 14:
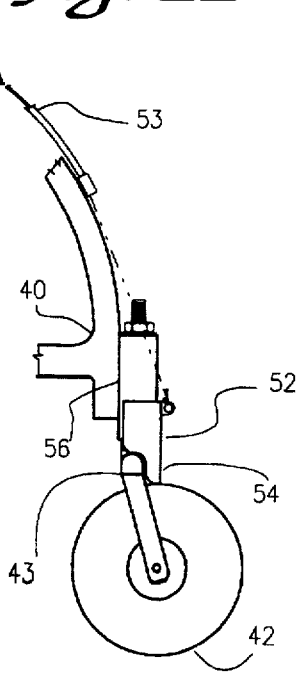
FIG. 14 is a side view of a preferred embodiment of a sliding collar used to prevent rotation of the rear wheel or wheels about a vertical axis, the view shows the collar in a braking position.

Referring now to FIG. 12 it can be seen that once the collar 52 is in a first, raised position, the tab 54 does not impede the rotation of the wheel support structure 43 about the vertical axis 38. Referring now to FIG. 13 it can be seen that once the collar 52 is slid down along the tubing 56 to a second position, the tab 54 will engage the wheel support structure 43 in a manner that will prevent rotation or turning of the wheel support structure 43 about a vertical axis 38. The tab 54 has been shown with rounded corners which improve the sliding of the collar 52 over the wheel support structure 43. As shown on FIG. 14, the collar 52 can be slid further along the tubing 56 to a position where the tab 54 engages the wheel 42, and thus preventing the free rotation of the wheel 42. Thus it can be appreciated that the collar 52 acts as a means for preventing the rotation of the wheels 42 about the vertical axis 38 as well as function as a brake.

As has been shown on FIGS. 11 through 14, the collar 52 may be actuated through a cable 53 which may then be connected to a three position lever (not shown) in order to allow easy actuation by the user.

Figure 16:
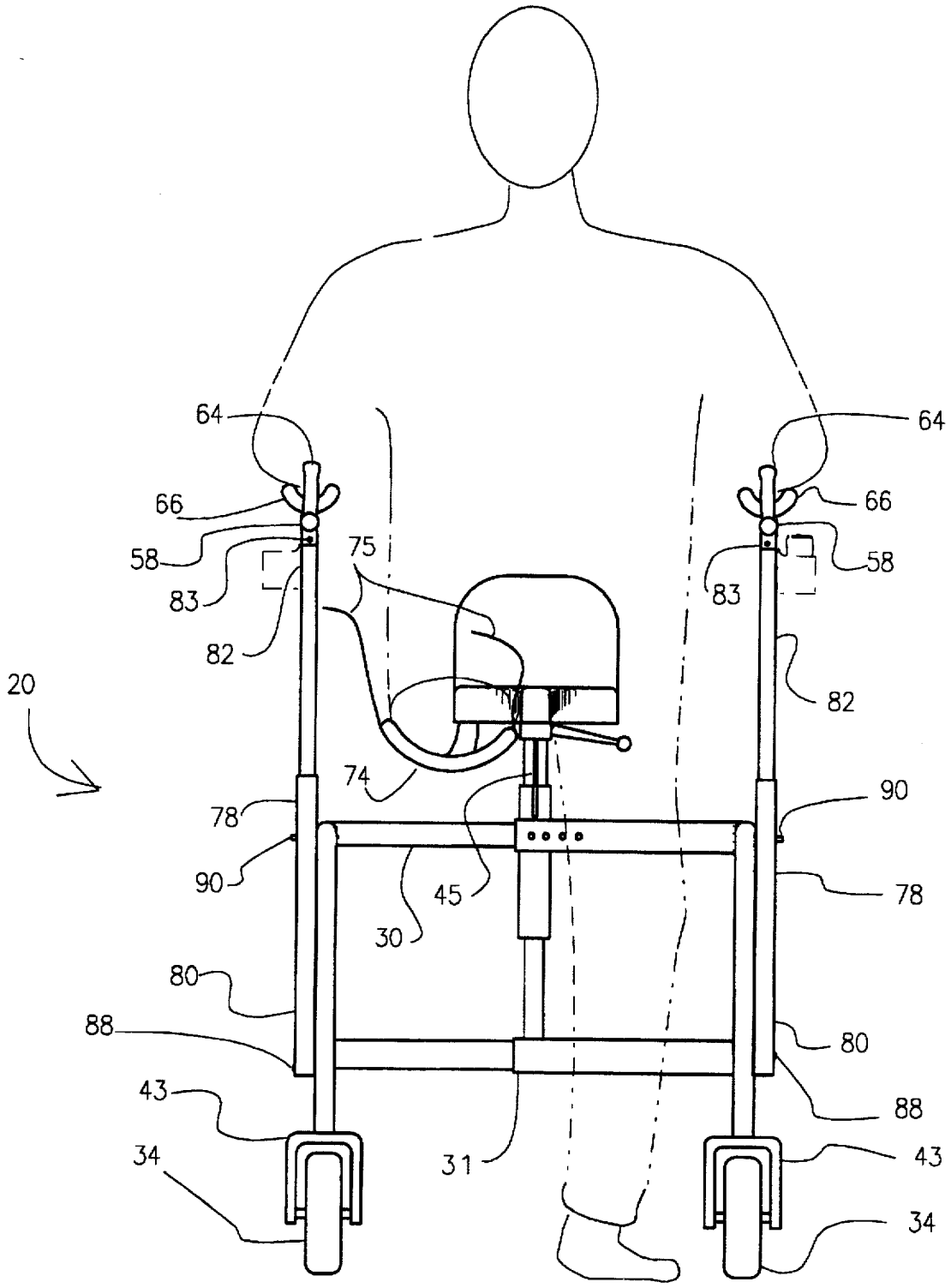
FIG. 16 is a front view of the invention incorporating a leg support for accommodating amputees.

Referring now to FIG. 16 it can be seen that the invention 20 may be used with a removeable leg support 74 which allows individuals who have lost a leg to use the device. By attaching the leg support 74 to the seat 48 one can allow the user to exert a forward impulse to the device 20 with a single leg. The leg support 74 has been shown with straps 75 which allow the user to use the invention 20 more effectively.

Thus the disclosed arrangement allows the walking assistance device 20 for use in indoor areas as well as in outdoor areas. In indoor areas the user is likely to encounter relatively flat floors which will pose no problems with tending to cause the walking assistance device to roll away. Moreover, in indoor settings the amount of room for maneuvering is likely to be limited; therefore, the maximum amount of maneuverability extractable from the invention must be used while moving around indoors. In outdoor settings, however the risk of rolling away is a very serious danger.

By fixing the position of the rear wheels to straight fore and aft orientation, one can materially enhance the ability to prevent the device 20 from rolling away. To prevent the device from rolling away sideways, for example, the device would have to include brakes that can accommodate the wheel support structure's ability to rotate about a vertical axis. This kind of mechanism is likely to be complicated and expensive. With the instant selectively releasable rear wheel support means incorporated into the instant invention, however, these complications can be obviated due the fact that the orientation of the rear wheels can be controlled.

Referring now to FIGS. 5 through 10, it can be appreciated that the disclosed walking assistance device will preferably include a pair of arm support means 58 having a first end 60 and a second end 62. The first end 60 of the arm support means includes hand grips 64 which help the user hold and control the device. Also, the hand grips may be used to support a brake lever for a breaking system similar to a bicycle's breaking system.

Next to the hand grips 64 is a forearm support 66 that provides the user with greater security in leaning against the arm support means 58. Referring once again to FIG. 2, it has been illustrated that the invention 20 allows the arm support means 58 to support article carriers 76, which will allow the user to carry drinks or a portable phone while using the device 20. Also illustrated in FIGS. 2, and 5 through 10 are the tool or utility article carrying means that have been incorporated into the hand grips 64 of the invention 20.

As can be seen on FIG. 2, the first end of the arm support means 58 are mounted on telescoping, adjustable supports 78. Each adjustable support 78 having a first end 80 and a second end 82. The first end 80 of the adjustable support 78 being pivotably attached to the spaced apart sides 24 of the frame 22. The second end 82 of the adjustable support 78 is attached to the second end 62 of the arm support means 58. Near the second end 82 of the adjustable supports 78 is a releasable catch 83 which allows the arm support means to be swung from a first position in general alignment with the spaced apart sides 24 to a second position which allows the support of a tool or utility article such as a tray 84 or an abdominal support 84. As can be seen on FIG. 9, the attachment of the tray 84 to the hand grips 64 may be accomplished by incorporating a female receiver 85 in the hand grips 64 and using a mating male portion 87 on the tray 84 or other utility article to be attached between the arm support means 58.

Thus the adjustable supports 78 may be folded down by pivoting the adjustable supports 78 along the path indicated by arrow 79 on FIG. 2 and about the pivot 88; which will allow easy stowage of the invention 20. A latch means 90 is incorporated to the sides of each spaced apart side 24 to retain the adjustable support in a raised position for use of the invention 20, or in a lowered position, which allows easy stowage of the invention 20.

It can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. A walking assistance device for use in indoor areas as well as in outdoor areas, the walking assistance device comprising:

frame means having:

a pair of spaced apart sides;

a pair of front wheels mounted to said frame means on means for allowing rotation of each of the front wheels about a vertical axis;

seat support means mounted between said spaced apart sides;

at least one rear wheel attached to said frame means on means for allowing rotation of the rear wheel about a vertical axis;

straddleable seat means mounted on the seat support means of said frame means; and means for selectively preventing the rotation of the rear wheel about a vertical axis, said means for selectively preventing the rotation of the rear wheel about a vertical axis comprising a slideable collar having means for engaging the means for allowing rotation of the rear wheel, the slideable collar being slideable between a first position where the means for allowing rotation of the rear wheel is prevented from allowing rotation of the rear wheel and a second position where the means for allowing rotation of the rear wheel allows rotation of the rear wheel, so that a person's body weight may be at least partially supported by said straddleable seat and said rear wheel allowed to rotate about a vertical axis as a person walks in an indoor area, and so that a person's body weight may be at least partially supported by said straddleable seat and said rear wheel prevented from rotating about a vertical axis as a person walks in an outdoor area.

2. A walking assistance device according to claim 1 and further comprising a pair of arm support means, each arm support means being attached to each of the spaced apart sides of said frame member by means of adjustable supports having a first and a second end, the first end of each adjustable support being attached at the first end to a spaced apart side of said frame member and at the second end to the said arm support means.

3. A walking assistance device according to claim 2, wherein said pair of arm support means have a first and a second end the first end having hand grips having means for accepting a utility article, the second end of each arm support means being attached to the second end of the adjustable support.

4. A walking assistance device according to claim 3, wherein each arm support means being attached to each of the spaced apart sides of said frame member by means of adjustable supports having a first and a second end, the first end of each adjustable support being pivotally attached at the first end to a spaced apart side of said frame member and at the second end to the second end of the arm support means.

5. A walking assistance device according to claim 4, wherein said seat support means comprises an adjustable gas filled cylinder.

6. A walking assistance device for use in indoor areas as well as in outdoor areas, the walking assistance device comprising:

frame means having:

a pair of sides joined in a spaced apart relationship by adjustable support means;

a pair of front wheels mounted to said frame means on means for allowing rotation of each of the front wheels about a vertical axis;

adjustable seat support means mounted between said spaced apart sides on the adjustable support means;

at least one rear wheel attached to said frame means on means for allowing rotation of the rear wheel about a vertical axis;

straddleable seat means mounted on the seat support means of said frame means;

a pair of arm support means, each arm support means being attached to each of the spaced apart sides of said frame member by means of adjustable supports having a first and a second end, the first end of each adjustable support being attached at the first end to a spaced apart side of said frame member and at the second end to the said arm support means;

means for selectively preventing the rotation of the rear wheel about a vertical axis, said means for selectively preventing the rotation of the rear wheel about a vertical axis comprising a slideable collar having means for engaging the means for allowing rotation of the rear wheel, the slideable collar being slideable between a first position where the means for allowing rotation of the rear wheel is prevented from allowing rotation of the rear wheel and a second position where the means for allowing rotation of the rear wheel allows rotation of the rear wheel, so that a person's body weight may be at least partially supported by said straddleable seat and said rear wheel allowed to rotate about a vertical axis as a person walks in an indoor area, and so that a person's body weight may be at least partially supported by said straddleable seat and said rear wheel prevented from rotating about a vertical axis as a person walks in an outdoor area.

7. A walking assistance device according to claim 6, wherein said pair of arm support means have a first and a second end the first end having hand grips having means for accepting a utility article, the second end of each arm support means being attached to the second end of the adjustable support.

8. A walking assistance device according to claim 7, wherein said adjustable supports comprise telescoping members.

9. A walking assistance device according to claim 7, wherein each arm support means being attached to each of the spaced apart sides of said frame member by means of adjustable supports having a first and a second end, the first end of each adjustable support being pivotally attached at the first end to a spaced apart side of said frame member and at the second end to the second end of the arm support means.

10. A walking assistance device according to claim 9, wherein said seat support means comprises an adjustable gas filled cylinder.

11. A walking assistance device for use in indoor areas as well as in outdoor areas, the walking assistance device comprising:

frame means having:

a pair of spaced apart sides having a forward end;

a pair of front wheels mounted to said frame means;

seat support means mounted between said spaced apart sides such that the spaced apart sides define an opening that allows access to the device from between the forward end of the spaced apart sides;

at least one rear wheel attached to said frame means;

means for selectively preventing the rotation of the at least one of the wheels about a vertical axis, said means for selectively preventing the rotation of the rear wheel about a vertical axis comprising a slideable collar having means for engaging the means for allowing rotation of the rear wheel, the slideable collar being slideable between a first position where the means for allowing rotation of the rear wheel is prevented from allowing rotation of the rear wheel and a second position where the means for allowing rotation of the rear wheel allows rotation of the rear wheel; and, straddleable seat means mounted on the seat support means of said frame means, the straddleable seat means being mounted such that a user may access the straddleable seat from between the forward end of the spaced apart sides and then walk with the walking assistance device while pulling the walking assistance device towards the forward end of the spaced apart sides.

12. A walking assistance device according to claim 11 and further comprising a pair of arm support means, each arm support means being attached to each of the spaced apart sides of said frame member by means of adjustable supports having a first and a second end, the first end of each adjustable support being attached at the first end to a spaced apart side of said frame member and at the second end to the said arm support means.

13. A walking assistance device according to claim 12, wherein each arm support means being attached to each of the spaced apart sides of said frame member by means of adjustable supports having a first and a second end, the first end of each adjustable support being pivotally attached at the first end to a spaced apart side of said frame member and at the second end to the second end of the arm support means.

14. A walking assistance device according to claim 13, wherein said seat support means comprises an adjustable gas filled cylinder.

* * * * *